United States Patent [19]

Yoshida

[11] Patent Number: 4,542,770

[45] Date of Patent: Sep. 24, 1985

[54] COMMAND DEVICE FOR DOBBY

[75] Inventor: Fumio Yoshida, Aichi, Japan

[73] Assignee: Kabushiki Kaisha Yamada Dobby, Bisai, Japan

[21] Appl. No.: 524,755

[22] Filed: Aug. 19, 1983

[30] Foreign Application Priority Data

Dec. 3, 1982 [JP] Japan ..... 57-211235

[51] Int. Cl.[4] ..... D03C 1/22

[52] U.S. Cl. ..... 139/68; 139/331

[58] Field of Search ..... 139/68, 71, 74, 331; 66/233, 231

[56] References Cited

U.S. PATENT DOCUMENTS 4,172,476 10/1979 Kleiner ..... 139/68

FOREIGN PATENT DOCUMENTS 51-15136 5/1976 Japan .

51-36829 10/1976 Japan .

*Primary Examiner*—James Kee Chi

*Attorney, Agent, or Firm*—Graybeal & Cullom

[57] ABSTRACT

A command device for a dobby machine, which device includes a pattern card having a plurality of perforations bored in a pattern corresponding to a desired fabric and driven in one direction and a feeler needle suspended from a horizontal needle and displaceable longitudinally while being guided by a guide member so as to permit the insertion of a lower end portion thereof into the perforations and the detection of presence or absence of the perforations in the pattern card, whereby to give an operational command to a drive mechanism of the dobby via the horizontal needle so as to cause a heald frame to undergo prescribed up-and-down movement for production of the desired fabric. The feeler needle is elastically flexible in the direction of motion of the pattern card at a portion below the guide member so as to avoid damages to edge portions of the perforations of the pattern card, which damages would otherwise take place due to repeated reciprocation of the feeler needle into and out of the perforations.

4 Claims, 6 Drawing Figures

COMMAND DEVICE FOR DOBBY

BACKGROUND OF THE INVENTION

This invention relates to a command device for a dobby which reciprocates the heald frame of a loom up and down.

A fabric having a desired structure and quality can be obtained by making a suitable selection as to the timing of up and down reciprocation of a heald frame. The timing of up and down reciprocation of the heald frame can be determined by controlling the drive mechanism of a dobby.

As a device for controlling the drive mechanism of a dobby, there is a command device which makes use of a pattern card perforated in a prescribed pattern.

In the above-mentioned command device, a feeler needle which is suspended from a horizontal needle extending out from the drive mechanism of the dobby is vertically displaced to scan the continuously driven pattern card, thereby mechanically detecting the presence or absence of the perforations. Results of the detection are then transmitted as an operational command to the drive mechanism of the dobby via the horizontal needle. Accordingly, the drive mechanism of the dobby is operated in such a manner that the heald frame is reciprocated up and down in accordance with the repeated reciprocation of the feeler needle into and out of the perforations in the pattern card.

A lower end portion of the feeler needle is however brought into contact with an edge portion of each perforation when the feeler needle is pulled upwardly from the perforation. This gives a damage to the edge portion of the perforation, leading to such problems that the control of the drive mechanism of the dobby becomes out of order and the durability and accuracy of the command device is lowered. These problems become more noticeable and serious as the dobby is operated at a higher speed, in other words, the moving speed of the pattern card increases.

It has conventionally been attempted to solve the above-described problems by reciprocating each feeler needle in horizontal directions at the same speed as the moving speed of the pattern card by means of a guide member which guides vertical movement of the feeler needle (see, Japanese patent publication No. 15136/76).

However, the above-described prior art device requires a special drive mechanism for reciprocating the guide member horizontally. In addition, an incorporation of such a special drive mechanism leads to another problem that the structure of the command device becomes complex.

Furthermore, the feeler needle is applied by a horizontal force while a guiding force is applied vertically to the feeler needle by the guide member. Thus, the guide member and feeler needle are both worn down to considerable extents due to friction therebetween, thereby making it difficult to maintain both of the feeler needle and guide member serviceable over a long time period.

SUMMARY OF THE INVENTION

An object of this invention is to provide a command device having excellent durability and accuracy without need for making its mechanism complex.

It has surprisingly been found that the above object can be achieved by making each feeler needle, which is vertically guided by its corresponding guide member, elastically flexible at a portion below the guide member in the direction of motion of a pattern card which is driven continuously, leading to completion of this invention.

In one aspect of this invention, there is thus provided a command device for a dobby, including an endless pattern card having perforations bored in a pattern corresponding to a desired fabric and driven in one direction and a feeler needle suspended from a horizontal needle and displaceable longitudinally while being guided by a guide member so as to permit the insertion of a lower end portion thereof into the perforations and the detection of presence or absence of the perforations in the pattern card, whereby to give the possibility or impossibility of insertion of the feeler needle into the perforations as an operational command to a drive mechanism of the dobby via the horizontal needle so as to control the motion of a heald frame for production of the desired fabric, characterized in that the feeler needle is elastically flexible in the direction of motion of the pattern card at a portion below the guide member so as to avoid damages to edge portions of the perforations of the pattern card, which damages would otherwise take place due to repeated reciprocation of the feeler needle into and out of the perforations.

In the command device according to this invention, each feeler needle is allowed to undergo elastic flection at the lower end portion thereof even if it is brought into contact with the edge portion of a perforation of the pattern card driven at high speed when it is pulled out of the perforation. The elastic flection is effective in reducing the resistance of the feeler needle to the edge portion, thereby successfully avoiding possible deformation of the perforation due to damages to the edge portion thereof.

It is thus unnecessary in the present invention to provide, for prevention of damages to the edge portions of perforations in a pattern card, a mechanism for driving each guide member so that the guide member undergoes horizontal movement, different from the conventional command device. The present invention permits simplification of the structure of a command device and avoids significant wearing of feeler needles and guide members, thereby making it possible to enhance the durability and accuracy of the command device.

The above and other objects, features and advantages of the present invention will become apparent from the following description and appended claims, taken in conjunction with the accompanying drawings.

DETAILED DESCRIPTION OF THE PREFERRED EMBODIMENTS

Figure 1:
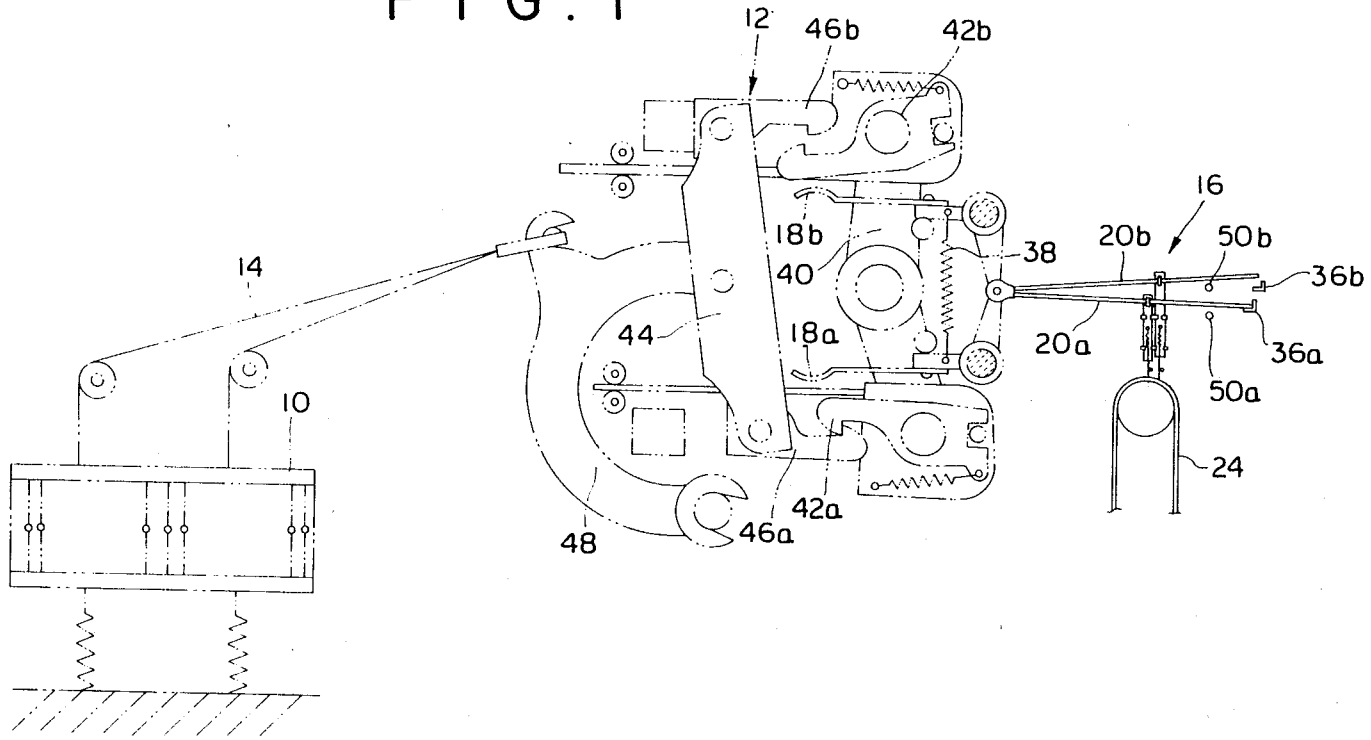
FIG. 1 is a front view of a command device according to one embodiment of this invention, in which the command device is illustrated in association with the drive mechanism of its matching dobby and a heald frame.

As shown in FIG. 1, a heald frame 10 of a loom is reciprocated up and down via a rope 14 by the actuation of a drive mechanism 12 of a dobby. The drive mechanism 12 of the dobby (hereinafter called merely "drive mechanism") is actuated in accordance with an operational command from a command device 16 according to the present invention.

Transmission of each operational command from the command device 16 to the drive mechanism 12 is effected via horizontal needles 20*a*,20*b* respectively and pivotally connected at one ends thereof to a pair of fish levers 18*a*,18*b* of the drive mechanism 12.

Figure 2:
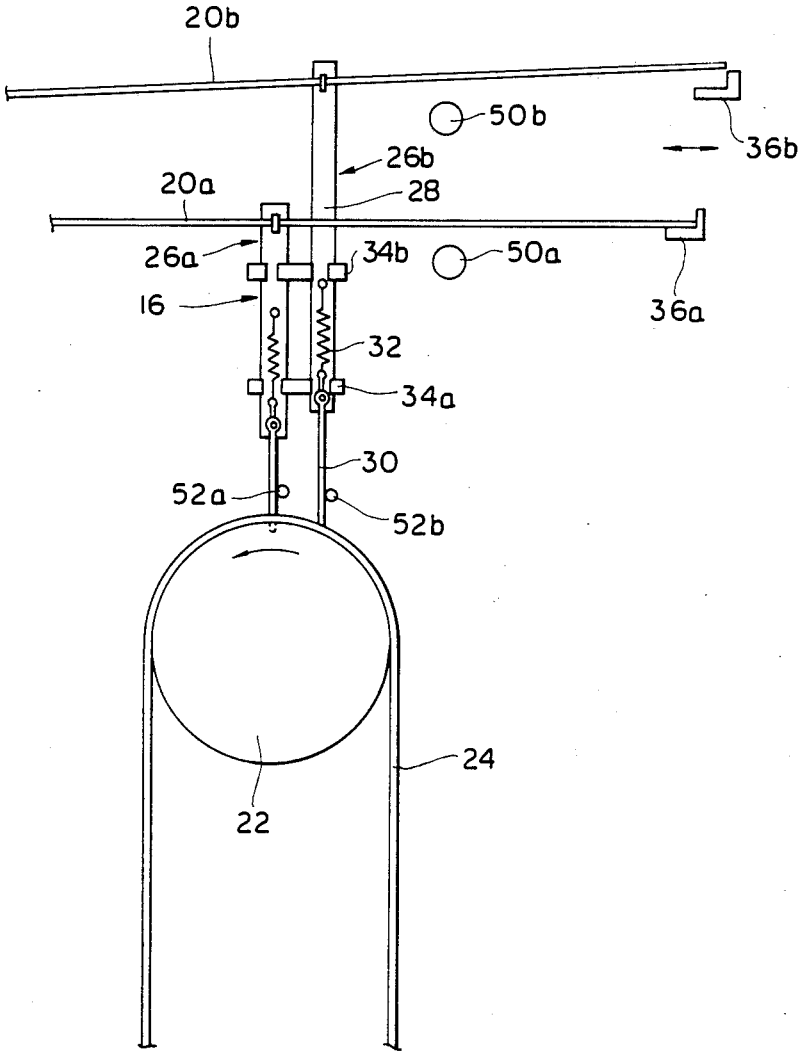
FIG. 2 is an enlarged front view of the command device of FIG. 1.

The command device according to this invention includes, as shown in FIG. 2, an endless pattern card 24 perforated in a prescribed pattern and continuously driven in one direction by means of a card cylinder 22 and feeler needles 26*a*,26*b* suspended from their corresponding horizontal needles 20*a*,20*b* so as to scan the paper card 24 and to detect the presence or absence of perforations in the pattern card 24. The card 24 is made of paper and/or plastic materials as conventional.

Each feeler needle is formed of an elongated plate 28 engaged at the upper end thereof displaceably with and relative to its corresponding horizontal needle, a pin 30 coupled pivotally in the direction of motion of the pattern card 24 to the lower end of the elongated plate 28 and capable of advancing into the perforations of the pattern card 24, and a spring member 32 connected at one end thereof to the upper end of the pin 30 and at the other end thereof to the elongated plate 28 and maintained under slight tension. The spring member 32 exerts a tensile force to the elongated plate 28 and pin 30 so that they are positioned along a common axis. Each feeler needle is restrained, displaceably in the lengthwise direction thereof right above the pattern card 24, by means of its corresponding stationary guide members 34*a*,34*b* which are disposed respectively at a position slightly above the point of pivotal connection between the elongated plate 28 and the pin 30 and at another position still above the former position.

When one of the perforations assumes a position right underneath either one of the feeler needles 26*a*,26*b*, for example, the feeler needle 26*a* owing to the motion of the pattern card 24 as illustrated in FIG. 1, the feeler needle 26*a* moves downwardly owing to its own weight or by virtue of the spring force of spring means (not shown) and the lower end of the pin 30 enters the perforation. Here, the horizontal needle 20*a* is swung clockwise and then brought into engagement at the free end thereof with a lower horizontal knife 36*a* which is horizontally reciprocated at a predetermined interval. On the other hand, the lower end of the pin 30 of the other feeler needle 26*b* is located between or among perforations of the pattern card 24 and kept in contact with the surface of the pattern card 24. Therefore, the free end of the horizontal needle 20*b* from which the feeler needle 26*b* is suspended is kept in a non-engagement position relative to an upper horizontal knife 36*b* which is periodically reciprocated with a slight phase difference from the lower horizontal knife 36*a*.

As has conventionally been well-known, the horizontal needle 20*a* which has been brought into engagement with the horizontal knife 36*a* is displaced leftwards on the drawing by the horizontal knife 36*a*. *This causes the lower fish lever 18a* of the drive mechanism 12 to pivot counterclockwise against the spring force of a spring 38 connected to both fish levers 18*a*,18*b*, thereby depressing and pivotally moving counterclockwise a hook 42*a* pivotally connected to one end of a periodically swinging drive lever 40.

When the thus pivotally-moving hook 42*a* engages with a hook 46*a* pivotally connected to one end of a swingable vertical lever 44, the vertical lever 44 is swung counterclockwise by the swinging motion of the drive lever 40 as has conventionally been well-known. This causes a jack lever 48 pivotally secured to the vertical lever 44 to swing clockwise, thereby lifting the heald frame 10 via the rope 14 which is connected to the jack lever 48.

While the horizontal needle 20*a* is moving together with the horizontal knife 36*a*, the pin 30 of the feeler needle 26*a* is pivotally moved against the spring force of the spring member 32 with its lower end still inserted in the perforation of the pattern card 24.

Figure 3:
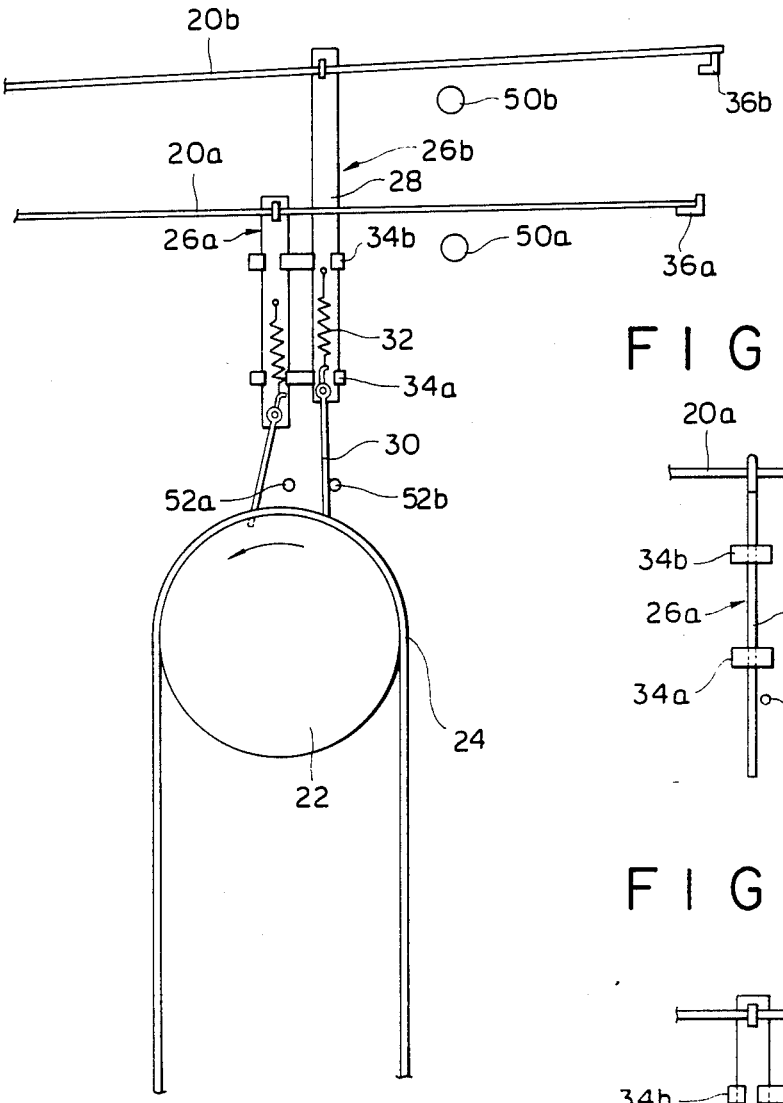
FIG. 3 is an enlarged front view of the command device of FIG. 1, in which one of the feeler needles is in an elastically-flexed state at a lower portion thereof.

When the pin 30 has pivotally moved over a prescribed angle of rotation as illustrated in FIG. 3, the horizontal needle 20*a* is lifted to a non-engagement position relative to the horizontal knife 36*a* and pivotally moved counterclockwise by means of a lifting knife 50*a* which is vertically reciprocated at a predetermined interval. With respect to the needle 20*b*, there is provided a lifting knife 50*b* similar to the knife 50*a*. In association with the counterclockwise movement of the needle 20*a*, the feeler needle 26*a* is lifted until the lower end of the pin 30 comes to a position coincided with the surface of the pattern card 24. Here, the pin 30 moves pivotally and counterclockwise due to the tensile force of the spring member 32 so as to return to its initial position and the pivotal movement of the pin 30 is then stopped by a stopper 52*a*. With respect to the pin 30 of the feeler needle 26*b*, there is provided a stopper 52*b* similar to the stopper 52*a*.

As shown in FIG. 3, the lower end of each of the pins 30 is restrained by a stopper 52*a* or 52*b* against movement in the direction opposite to the direction of motion of the pattern card 24, but the lower end of each pin 30 is free and unrestrained to be elastically flexed and moved with the pattern card in the direction of motion of the pattern card 24 if the lower end of the pin enters a performation in the pattern card 24.

The pivotal movement of the pin, that is, the elastic flection of the feeler needle is effective in reducing the resistance between the feeler needle and the edge portion of the perforation of the card when the feeler needle is pulled out, thereby successfully avoiding possible deformation of the perforation.

When an upward lifting force is applied to the horizontal needle 20*a* by the lifting knife 50*a*, the horizontal knife 36*a* moves to the return stroke and the horizontal needle 20*a* is displaced rightwards owing to the restoring force of the spring 38 of the fish lever 18*a* while moving pivotally and counterclockwise. Accordingly, the engagement between both hooks 42*a* and 42*b* is released and the heald frame 10 is allowed to move downwardly owing to its own weight and the spring force.

The feeler needle 26*b* is operated in the same manner as the feeler needle 26*a* except that each operational command from the command device 16 to the drive mechanism 12 is transmitted through the upper horizontal needle 20*b* and fish lever 18*b* and both upper hooks 42*b*,46*b* are brought into engagement in the drive mechanism 12.

Figure 4A:
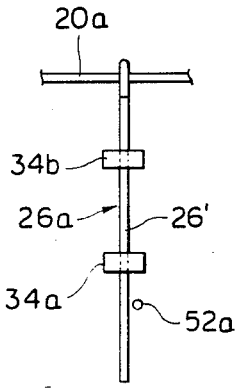
FIGS. 4A and 4B are front views showing other embodiments of the feeler needles shown in FIG. 1, respectively.
Figure 4B:
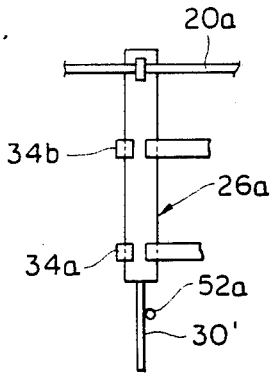

Instead of the above-described embodiment in which the feeler needles 26*a*,26*b* are formed by the elongated plates 28, pins 30 and spring members 32 respectively so as to make the pins 30 pivotal under the application of the spring forces thereto at portions below their respective lower guide members 34*a*, each feeler needle may be formed with a leaf spring 26′ in its entirety as shown in FIG. 4A or may be formed with a leaf spring at a portion 30′ below the guide member 34*a* as shown in FIG. 4B.

Figure 5:
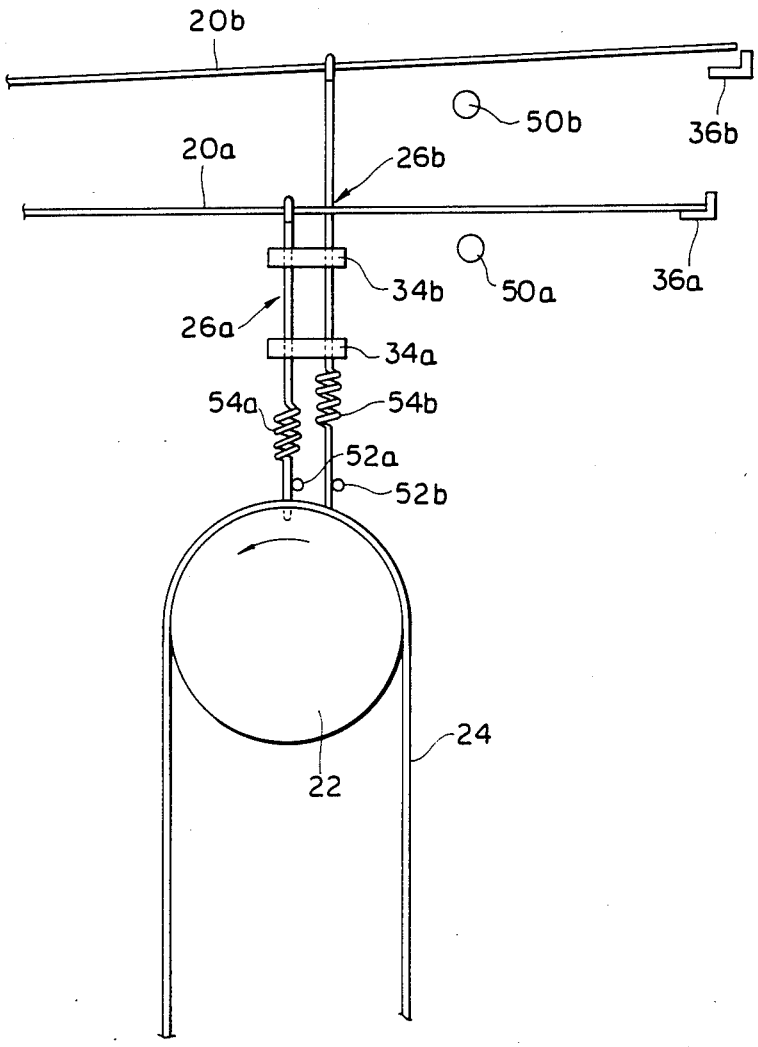
FIG. 5 is an enlarged front view of a command device according to another embodiment of this invention.

In place of these embodiments, the feeler needles 26*a*,26*b* may alternatively be formed of generally wire-like members which include coil spring portions 54*a*,54*b* respectively, as shown in FIG. 5. The coil spring portions 54*a*,54*b* are located adjacent to the lower ends of the wire-like members and below their corresponding guide members 34*a*,34*a*.

In each of the above embodiments shown in FIGS. 4A, 4B and 5, the feeler needles are elastically flexed in the direction of motion of the pattern card at portions below their corresponding guide members 34*a*,34*a*, similar to the feeler needles 26*a*,26*b* depicted in FIGS. 1, 2 and 3, when the feeler needles have been inserted at their lower end portions into perforations of the moving pattern card and are then pulled upwardly.

Having now fully described the invention, it will be apparent to one of ordinary skill in the art that many changes and modifications can be made thereto without departing from the spirit or scope of the invention as set forth herein.

What is claimed is:

1. A command device for a dobby, including:

(a) an endless pattern card having perforations bored in a pattern corresponding to a desired fabric and driven in one direction;

(b) a feeler needle suspended from a horizontal needle and displaceable longitudinally while being guided by a guide member so as to permit the insertion of a lower end portion thereof into the perforations and the detection of the presence or absence of the perforations in the pattern card, whereby to give the possibility or impossibility of insertion of the feeler needle into the perforations as an operational command to a drive mechanism of the dobby via the horizontal needle so as to control the motion of a heald frame for production of the desired fabric;

(c) said lower end portion of said feeler needle below said guide member being restrained by a stopper against movement in the direction opposite to the direction of motion of said pattern card, but said lower end portion of said feeler needle below said guide member being free and unrestrained to be elastically flexed and moved with the pattern card in the direction of motion of the pattern card after entering a perforation in the pattern card, so as to avoid damage to edge portions of the perforations of the pattern card, which damage would otherwise take place due to repeated reciprocation of the feeler needle into and out of the perforations.

2. A command device as claimed in claim 1, wherein the feeler needle comprises an elongated planar spring member.

3. A command device as claimed in claim 1, wherein the feeler needle comprises an elongated planar member, a pin pivotally connected to the lower end of the planar member, and a spring member connected at its upper end to the planar member and connected at its lower end to the upper end portion of the pin, said spring being expandable in the lengthwise direction of the planar member.

4. A command device as claimed in claim 1, wherein the feeler needle comprises a pin which is formed into a coil spring portion adjacent to the lower end thereof.

* * * * *